US008222987B2

(12) United States Patent
Gerhard

(10) Patent No.: US 8,222,987 B2
(45) Date of Patent: Jul. 17, 2012

(54) SUPPORTING COMPONENT, INTERFERENCE SUPPRESSION COIL DEVICE AND METHOD FOR THE MANUFACTURE THEREOF

(75) Inventor: Karl Gerhard, Breitenberg (DE)

(73) Assignee: Vogt Electronic AG, Obernzell (DE)

( * ) Notice: Subject to any disclaimer, the term of this patent is extended or adjusted under 35 U.S.C. 154(b) by 284 days.

(21) Appl. No.: 11/662,260

(22) PCT Filed: Sep. 9, 2005

(86) PCT No.: PCT/EP2005/009733

§ 371 (c)(1),
(2), (4) Date: Jul. 12, 2007

(87) PCT Pub. No.: WO2006/027268

PCT Pub. Date: Mar. 16, 2006

(65) Prior Publication Data

US 2008/0055035 A1 Mar. 6, 2008

(30) Foreign Application Priority Data

Sep. 9, 2004 (DE) ..... 20 2004 014 066 U

(51) Int. Cl.

| | |
|---|---|
| ***H01F 27/06*** | (2006.01) |
| ***H01F 27/02*** | (2006.01) |
| ***H01F 5/00*** | (2006.01) |
| ***H01F 27/30*** | (2006.01) |
| ***H01F 27/28*** | (2006.01) |

(52) U.S. Cl. ..... 336/65; 336/90; 336/200; 336/206; 336/207; 336/208; 336/229

(58) Field of Classification Search ..... 336/65, 336/90, 200, 206–208, 229
See application file for complete search history.

(56) References Cited

U.S. PATENT DOCUMENTS

| | | | | |
|---|---|---|---|---|
| 3,872,399 | A | 3/1975 | Friberg et al. | |
| 4,084,068 | A | 4/1978 | Lepik et al. | |
| 4,268,810 | A | 5/1981 | Iwasa et al. | |
| 4,571,569 | A | 2/1986 | Scharl | |
| 4,629,843 | A * | 12/1986 | Kato et al. | 336/65 |
| 4,975,672 | A * | 12/1990 | McLyman | 336/198 |
| 4,994,952 | A * | 2/1991 | Silva et al. | 363/56.01 |
| 5,619,174 | A * | 4/1997 | Kimura et al. | 333/181 |
| 2002/0017976 | A1 * | 2/2002 | Okamoto | 336/229 |

FOREIGN PATENT DOCUMENTS

| | | |
|---|---|---|
| DE | 1 027 265 | 4/1958 |
| DE | 37478 | 3/1965 |
| DE | 51938 | 11/1966 |
| DE | 7309528 U | 3/1973 |
| DE | 82 07 239 U1 | 9/1982 |

(Continued)

*Primary Examiner* — Elvin G Enad
*Assistant Examiner* — Tsz Chan
(74) *Attorney, Agent, or Firm* — Birch, Stewart, Kolasch & Birch, LLP

(57) ABSTRACT

A supporting component (10) for assembling an inductive element comprises a base on the top face of which a protrusion for accommodating the inductive element is embodied, wherein a recess is provided in said protrusion for receiving an electronic component and/or a ferrite element. Furthermore, an interference suppression coil device with a supporting component is provided, wherein the supporting component comprises a protrusion serving for accommodating an interference suppression coil. Moreover, a method for the manufacture of an inductive component to be assembled on a printed circuit board is provided.

18 Claims, 4 Drawing Sheets

FOREIGN PATENT DOCUMENTS

| | | | | |
|---|---|---|---|---|
| DE | 81 29 597 | U1 | | 7/1983 |
| DE | 33 18 557 | A1 | | 11/1984 |
| DE | 3318557 | A1 | * | 11/1984 |
| DE | 33 30 881 | C2 | | 3/1985 |
| DE | 85 26 034 | U1 | | 1/1986 |
| DE | 41 14 036 | A1 | | 9/1992 |
| DE | 42 39 818 | C2 | | 6/1994 |
| DE | 19756578 | A1 | | 7/1999 |
| DE | 198 15 852 | A1 | | 10/1999 |
| DE | 299 08 197 | U1 | | 1/2000 |
| DE | 298 23 886 | U1 | | 5/2000 |
| DE | 299 12 921 | U1 | | 8/2000 |
| DE | 102 23 995 | C1 | | 11/2003 |
| DE | 20 2004 000642 | U1 | | 3/2004 |
| EP | 258592 | A1 | * | 3/1988 |
| EP | 1 077 590 | A | | 2/2001 |
| GB | 1344951 | | | 1/1974 |
| GB | 1 416 403 | A | | 12/1975 |
| GB | 1458894 | | | 12/1976 |

* cited by examiner

SUPPORTING COMPONENT, INTERFERENCE SUPPRESSION COIL DEVICE AND METHOD FOR THE MANUFACTURE THEREOF

FIELD OF THE INVENTION

The present invention relates to a supporting component for assembling an inductive element as well as an interference suppression coil device with an interference suppression coil and a method for the manufacture of these components.

DESCRIPTION OF THE PRIOR ART

For assembling inductive elements, such as interference suppression coils, these are assembled on a printed circuit board or another appropriate support and provided with a ferromagnetic core. The interference suppression coil as well as the core are fixed on the printed circuit board as individual parts. With such an assembling of the printed circuit board with the suppression coils, it is disadvantageous that in the process several components have to be assembled which leads to increased amount of work required and can result, due to imprecise positioning of the core in the interference suppression coil, in a worse tolerance range for the inductance values.

From the DE 19756578 A1, an interference suppression coil with a closed frame core is known, wherein two diametrically opposed suppression coils are wound around the core. Furthermore, a magnetic by-pass is provided which is embodied in the form of a web at an edge side of the core. The web is held in two notches in the closed core and extends from one notch to the other one, where the web rests on glass beads mixed with an adhesive and does not touch the notches directly.

Although this construction permits complete assembly of the interference suppression coil before its installation into the printed circuit board, the problem of handling several components when the interference suppression coil is assembled remains, resulting in increased production costs.

By a plurality of electronic components on one printed circuit board together with an interference suppression coil device, it is often necessary for design reasons to select the dimensions of the printed circuit board to be correspondingly large, so that a miniaturization of plants in which inductive elements are used is often only possible to a very low degree.

In view of the above mentioned problems of the prior art and the illustrated technical problems, the object underlying the present invention is to provide an inductive element with reduced size that is easy to manufacture and the inductive properties of which can be predetermined with improved accuracy.

According to one aspect of the present invention, this object is achieved by a supporting component for assembling an inductive element, wherein the supporting component comprises a base with a top face and a bottom face as well as a protrusion formed at the top face for accommodating the inductive element. Furthermore, the supporting component comprises a recess formed in the protrusion for accommodating an electronic component and/or a ferrite element.

Due to the structure of the supporting component according to the invention, on the one hand a relatively accurate adjustment of the inductive element, for example a toroidal core, or the like can be achieved, so that after the assembly of the supporting component and the inductive element, an inductive component with a low tolerance is given due to the good positionability of the inductive element. Furthermore, the recess provided in the protrusion permits to accommodate further components, for example electronic components, in the supporting component in an extremely space-saving manner, so that in particular in the miniaturization of printed circuit boards, higher design flexibility results. Further, the recess can serve for accommodating a ferrite element, so that in particular the inductive properties of the overall component, i.e. of the supporting component including the inductive element, can be adapted corresponding to the requirements, so that without changing the supporting component and/or the inductive element, different inductive properties can be achieved, or that on the other hand by corresponding adjustment desired inductive properties can be adjusted with high precision.

In a further advantageous embodiment, the recess ends in the bottom face of the base. In this manner, in a very efficient way a corresponding electronic component or a ferrite element can be inserted into the recess. Furthermore, when the supporting component assembled with the inductive element is placed onto a printed circuit board, the supporting component can be possibly arranged over an already placed electronic component, so that a more efficient utilization of the available space on the printed circuit board can be achieved.

In a further advantageous embodiment, the recess ends in a periphery of the protrusion facing away from the top face of the base.

With this embodiment, thus the recess has an opening at the top face of the protrusion, so that a corresponding electronic component and/or a ferrite element can be simply inserted into the recess, independent of whether the supporting component is already mounted on a printed circuit board. Further, due to the good accessibility of the recess, an adjustment of the inductive properties can possibly only be performed in the mounted state, for example by varying the position of a ferrite element and/or by providing different types of ferrite elements, so that possibly also the adjustment can be performed on the basis of the electronic behavior of a printed circuit board. In particular in combination with a recess open at the bottom and the top, the advantages, for example achieved by accommodating an electronic component at the bottom face as well as a ferrite element at the top face, can be advantageously combined.

In an advantageous further development, the base is a one-piece moulded plastic part, so that thus an inexpensive manufacturing process as well as high production accuracy can be achieved in a large scale manufacture.

Preferably, the base is made of plastoferrite.

In a further embodiment, the protrusion is formed axially symmetrically with respect to an axis of symmetry extending perpendicularly to the top face of the base. A corresponding symmetric embodiment can facilitate the assembly process, in particular if correspondingly symmetrically formed inductive elements, for example suppression coils with two windings on one toroidal core and the like are used.

In a further advantageous embodiment, the protrusion comprises at least one lateral swelling for positioning the inductive element. In this manner, high positioning accuracy can be achieved when the inductive element is assembled onto the supporting component, so that on the one hand the assembly process per se is very simple and on the other hand the resulting component tolerances of the mounted component can be clearly reduced.

Advantageously, the at least one swelling is embodied for frictional engagement with a toroidal core at least partially provided with windings. Due to this construction, standard inductive elements, for example suppression coils and the like, which are typically wound on a toroidal core, can be very accurately positioned, so that assembly tolerances occurring in the process can be kept very low.

According to a further aspect, an interference suppression coil device is provided, wherein the interference suppression coil device comprises an interference suppression coil with a toroidal core and a supporting component for accommodating the interference suppression coil. Here, the supporting component is provided with a base with a top face facing the interference suppression coil and a protrusion embodied at the top face, wherein the toroidal core at least partially encloses the protrusion.

This construction of the interference suppression coil device according to the invention ensures an extremely accurate assembly of the interference suppression coil on the supporting component, wherein also the assembly process itself is facilitated due to the partial enclosure and thus the good positionability of the interference suppression coil.

In a further embodiment, the toroidal core is a closed toroidal core. Thus, the interference suppression coil device of the present invention is in particular also suited for standard toroidal cores of suppression coils.

In a further embodiment, the interference suppression coil comprises at least two suppression coils wound around the toroidal core.

In a further embodiment, the at least two suppression coils are arranged essentially diametrically opposed with respect to the toroidal core. Due to this construction, a high degree of symmetry of the two suppression coils can be achieved, so that in combination with the increased production accuracy and the facilitated assembly process, altogether a cheaper solution is provided with the same or a higher accuracy.

In a further embodiment, a recess for accommodating an electronic component and/or a magnetic element is embodied in the protrusion. Thus, as already described with respect to the above described supporting component, correspondingly higher flexibility of the use of the interference suppression coil device can be achieved, as for example an essentially more space-saving arrangement on a printed circuit board and/or the adjustment of the inductive properties of the interference suppression coil are possible due to the provision of a corresponding magnetic element.

In further advantageous embodiments, the design of the supporting component is provided in the manner already described above, so that the previously represented advantages also result therefrom.

In a further advantageous embodiment, several terminal pins are provided, wherein at least one terminal pin is connected to a conductor leading to the recess. Due to this embodiment, a corresponding electronic component in the recess can be efficiently connected to peripheral components, so that for example already before the assembly of the interference suppression coil device onto a printed circuit board, a corresponding component can be arranged in the recess.

In further advantageous embodiments, the electronic component comprises a capacitor and/or a fuse and/or a diode.

According to a further aspect of the present invention, a method for the manufacture of an inductive component to be accommodated on a printed circuit board is provided. The method comprises the steps of: assembling an inductive element on a supporting component that can be embodied according to the previously described embodiments. inserting an electronic component and/or a magnetic element into the recess and fixing the electronic component and/or the magnetic element by frictional engagement and/or bonding.

By means of this method, a very efficient and also space-saving assembly of an inductive component can be realized, wherein in particular the insertion of the component and/or the magnetic element can be advantageously utilized to thus achieve better performance and/or lower assembly costs. For example, by the introduction of appropriate electronic components, the overall behavior of the inductive element can be improved, for example by the possibility of assembling a corresponding diode or another component directly approximate to the windings forming the inductive component. Thus, possible spikes, for example if the electronic component is provided as recovery diode, can be kept low in other circuit areas of the printed circuit board. In other embodiments, the inductive property of the element can be amended as desired by corresponding positioning of a magnetic element or by the selection and provision of different magnetic elements. Depending on the application of the desired mechanical fixing, permanent or releasable mechanical fixing can be achieved, so that in this respect, too, high flexibility with respect to the assembly as well as the adjustment of component properties results.

In a further advantageous embodiment, the method comprises the adjustment of the inductance of the inductive element by introducing the magnetic element and adjusting the position of the magnetic element in the recess corresponding to a predetermined nominal value. As already illustrated before, in this manner the desired behavior of the inductive element can be flexibly achieved, wherein with a predetermined dimensioning of the supporting component, very different inductance values can be achieved, wherein each individual value is enabled with only slight deviation from a corresponding nominal value.

That is, according to the invention, in one aspect a relocation of electronic components or magnetic components into the base of a supporting component is achieved, which can result in a reduction of a number of electronic components directly arranged on the printed circuit board and finally in a reduction of the size of the printed circuit board itself.

On the other hand, an interlocking embodiment of the protrusion in the above illustrated supporting component results in the possibility of a core with suppression coils arranged thereon being brought into an essentially clearly definable position that is reproducible to a great extent, so that a desired value of inductance properties can be purposefully adjusted.

DETAILED DESCRIPTION OF THE INVENTION

Figure 1:
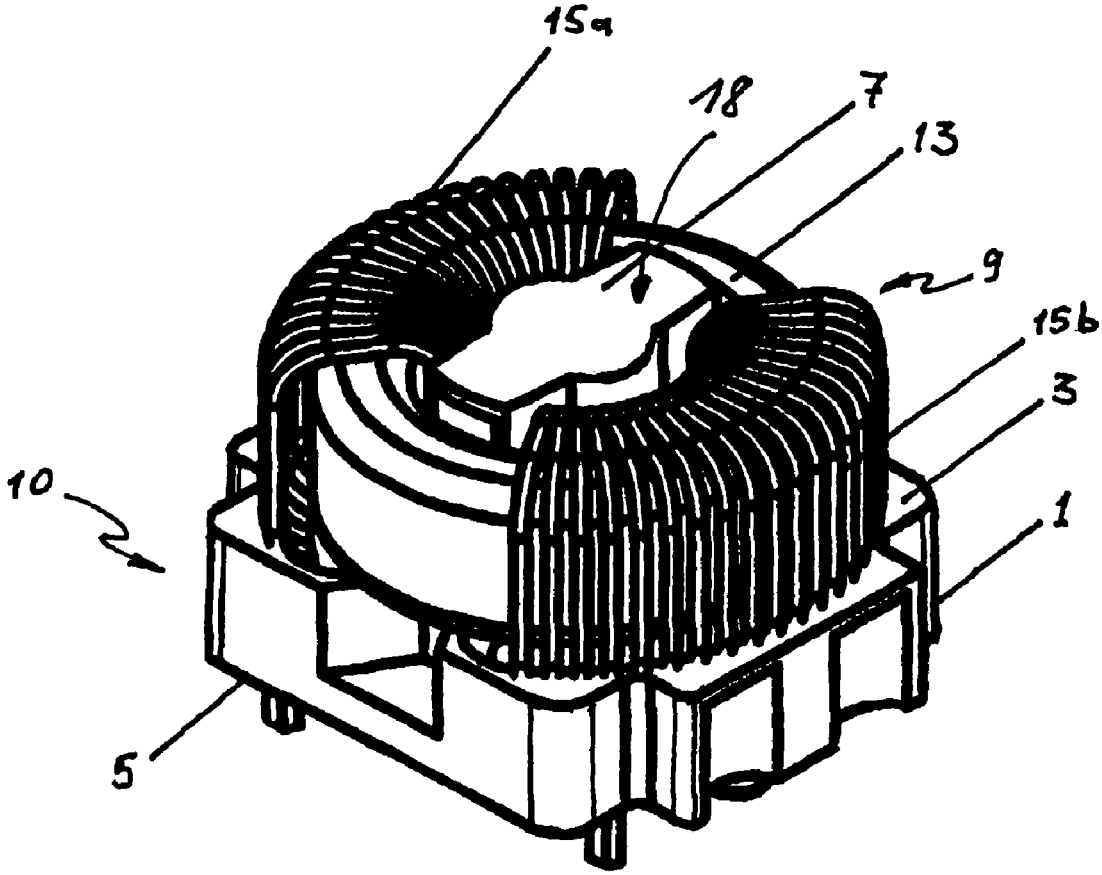
FIG. 1 shows a perspective view of an interference suppression coil device with a supporting component and an interference suppression coil according to the present invention.

FIGS. 1 to 4 show an embodiment of an interference suppression coil device according to the invention with a supporting component 10 and an interference suppression coil 9 fixed on this supporting component 10.

The supporting component 10 comprises a base 1 with a top face 3 and a bottom face 5. In one embodiment, the base 1 can have an essentially rectangular flat structural shape, wherein corresponding lateral parts can be provided as required in addition to the inherent rectangular basic shape, as can be easily seen in FIG. 1 and FIG. 4. On the top face 3 of the base 1, a protrusion 7 is formed and extends in one embodiment perpendicularly to the top face 3 of the base 1 and has an appropriate cross-sectional form, wherein the cross-section is intended as a cross-section essentially in parallel to the top face 3 of the base 1. As can be easily seen in FIG. 1 and FIG. 4, in one embodiment, the cross-sectional form is essentially rectangular, wherein in the centre an essentially circular bulging is provided, so that a circular expansion results on the longitudinal side of the protrusion 7. In one embodiment, the top face 18 of the protrusion 7 thus forms an essentially plane surface which can serve for vacuum exhaust for the assembly if the supporting component 10 is provided as SMD. In the protrusion 7, a recess 11 for accommodating an electronic component and/or a ferrite element or a magnetic element, respectively, is provided, wherein in one embodiment, the recess ends in the bottom face 5 of the base 1. In this embodiment, the recess 11 extends from the bottom face 5 of the base 1 to the wall 8 of the protrusion 7 facing away from the top face 3 of the base 1 and has in cross-section an essentially rectangular shape essentially corresponding to the rectangular cross-sectional form of the protrusion 7. In a further embodiment, the recess 11 is designed without the unilateral limitation by the wall 8 of the protrusion 7, so that the recess 11 is opened at both sides. In other embodiments, the recess 11 can be formed at the top face and does not end in the bottom face 5 of the base 1. The recess 11 serves for accommodating an electronic component and/or a ferrite element or a magnetic element (not shown) which can be accommodated in the recess 11 in an interlocking manner. Preferably, the supporting component 10 is made of plastic, for example hard plastic or plastoferrite, and can be manufactured by injection-moulding. In other embodiments, one part of the base 1, for example the protrusion 7, can be made of plastoferrite.

An inductive element, for example an interference suppression coil 9, is fixed on the supporting component 10, which in one embodiment is made of a toroidal core 13, for example a closed toroidal core made of ferrite, and about which one or several suppression coils 15*a* and 15*b* are wound. In one embodiment, several suppression coils 15*a*, 15*b* are provided which are arranged diametrically opposed with respect to the toroidal core 13. In one embodiment, the inductive element or the interference suppression coil 9, respectively, encloses the protrusion 7 with its toroidal core 13, wherein the one or the several suppression coils 15*a* and 15*b* are arranged at both sides of the protrusion 7 and adjacent to the circular expansions or the bulging of the protrusion 7. This results in an interlocking accommodation of the protrusion 7 in the toroidal core 13, whereby in turn reproducible positioning of the interference suppression coil 9 on the supporting component 10 is achieved. In particular, the shape of the protrusion 7 can in this case be such that swellings formed by winding on the toroidal core 13 are engaged with the protrusion 7 in an interlocking manner.

The height of the protrusion 7 with respect to the top face 3 of the base 1 in the shown embodiment corresponds approximately to the height of the interference suppression coil 9, resulting in a quite compact design. In other embodiments, the height can be selected differently, so that for example the top face of the protrusion 7 remains clearly underneath the suppression coil 9, if for example toroidal cores with essentially rectangular cross-section are used. In such an arrangement, accurate mechanical fixing can be even realized with a low height of the protrusion 7, so that possibly with only little material for the protrusion 7, good positioning can be achieved. In other embodiments, the protrusion 7 can project beyond the suppression coil 9, for example if the provision of a corresponding lid at the top face of the protrusion 7 for further mechanically fixing the suppression coil 9 is provided.

The embodiment of the interference suppression coil device shown in FIGS. 1 to 4 comprises the supporting component 10 with a protrusion 7 which has an axially symmetrical design, wherein the axis of symmetry of the protrusion 7 extends perpendicularly to the top face 3 of the base 1. In other embodiments, the protrusion 7 can also have an asymmetric design to thus allow for the number or arrangement of the suppression coils 15*a*, 15*b* on the toroidal core 13 or the shape of the toroidal core 13 with desired interlocking of the protrusion 7 and the suppression coil 9.

The recess 11 in the protrusion 7 can also be used for accommodating an electronic component, for example a capacitor, a fuse, a diode or a ferrite element (not shown) or a magnetic element. The electronic component or the ferrite element can be held in the recess 11 either by frictional engagement or by bonding. Particularly advantageous is the possibility of shifting a ferrite element or a magnetic element, respectively, (not-shown) in the recess 11, by which the inductance properties of the interference suppression coil can be optionally changed.

Figure 2:
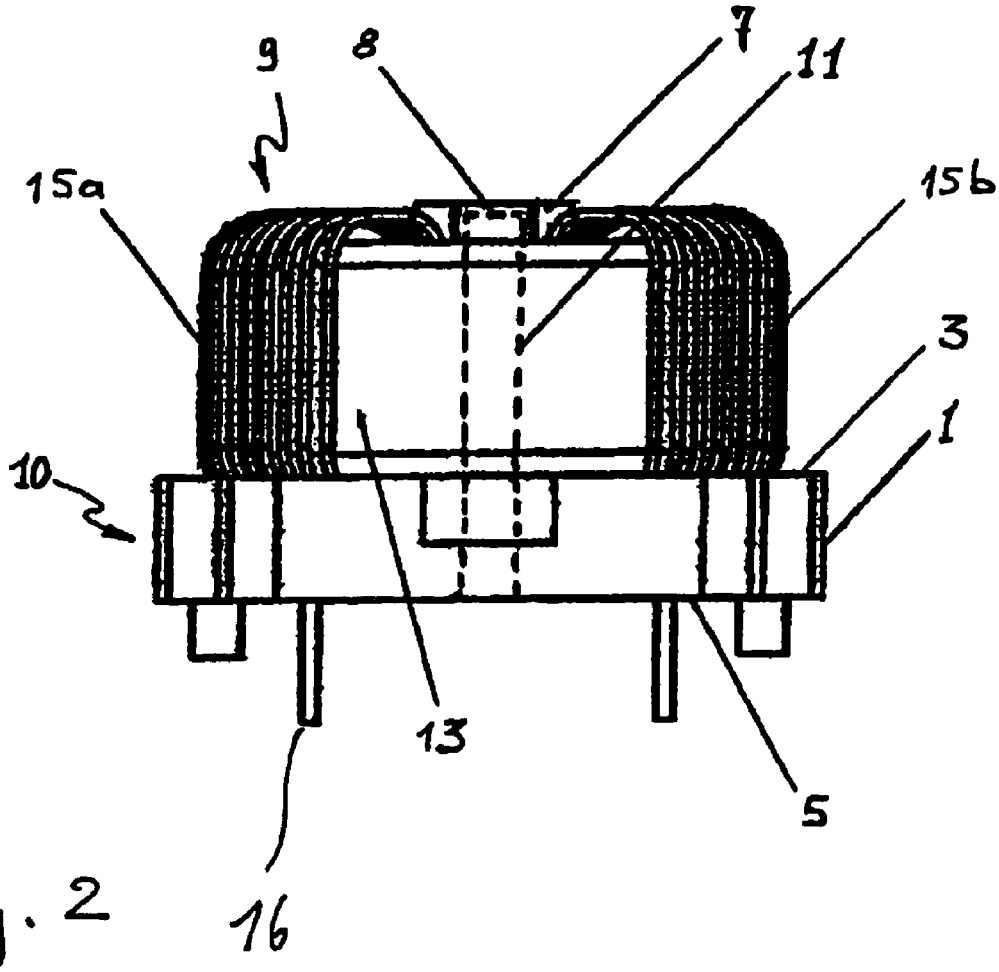
FIG. 2 shows an alongside view of the interference suppression coil device shown in FIG. 1.
Figure 3:
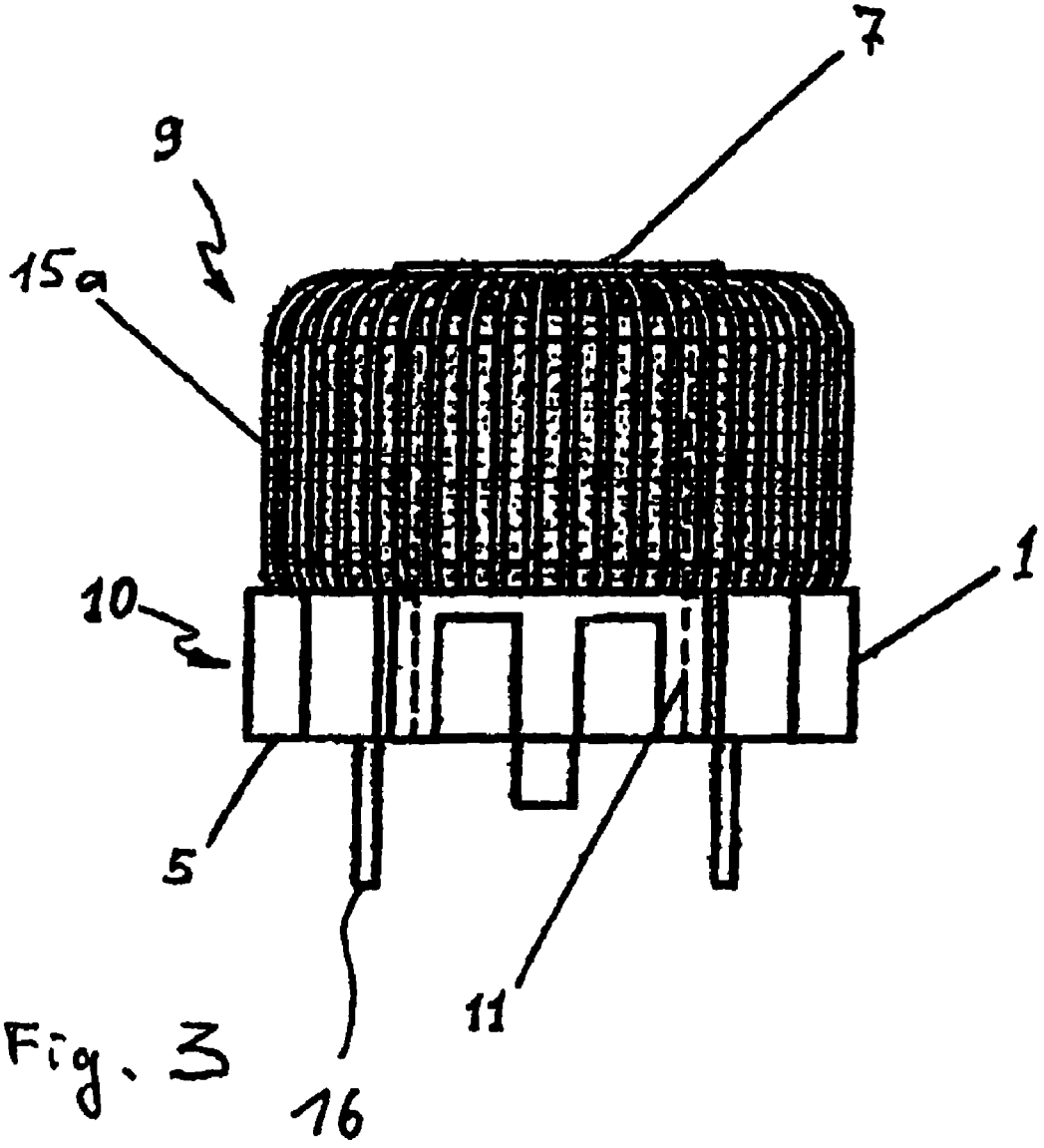
FIG. 3 shows a short-side view of the interference suppression coil device shown in FIG. 1.
Figure 4:
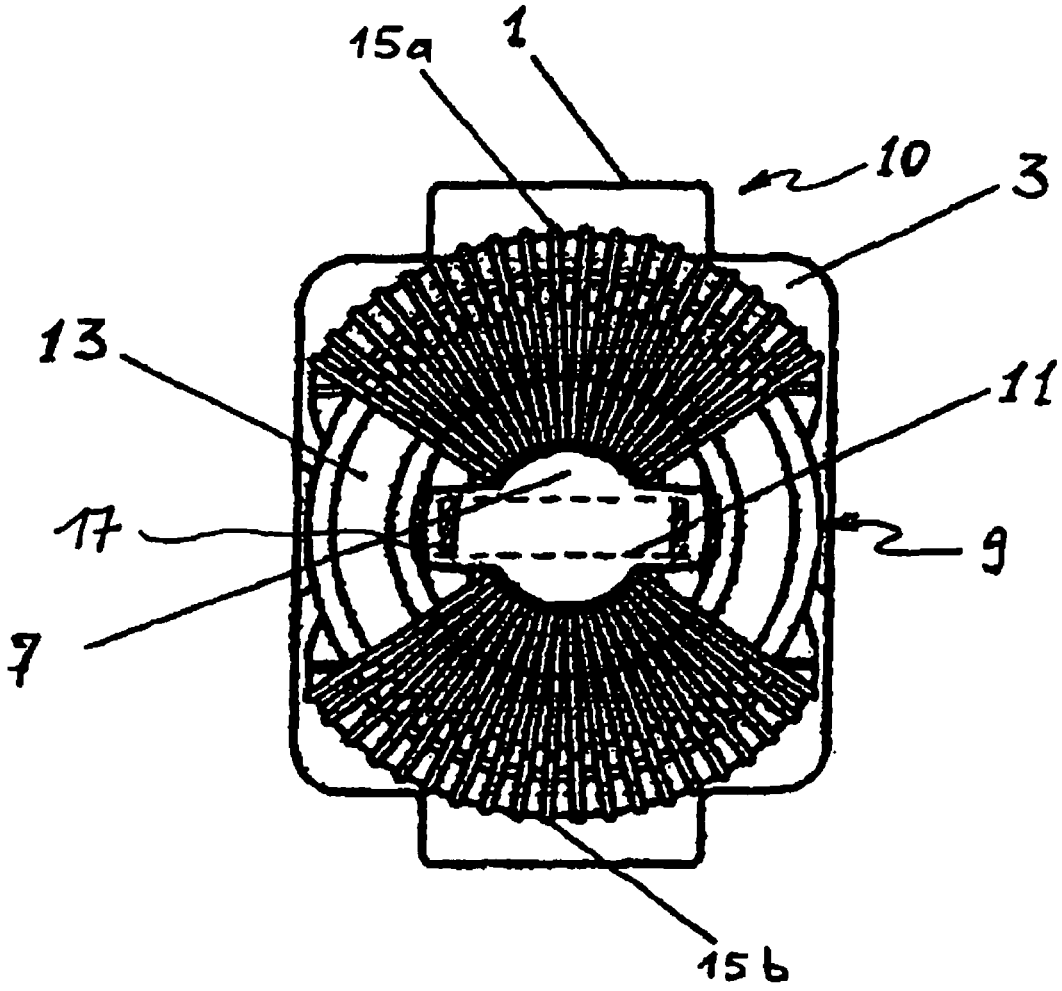
FIG. 4 shows a plan view of the interference suppression coil device shown in FIG. 1.

As shown in FIG. 2, terminal pins 16 are provided in the supporting component 10 in one embodiment, wherein the terminal pins 16 can be connected to winding ends of the suppression coils 15*a*, 15*b*. In other embodiments, one or several ones of the terminal pins 16 are electrically connected by a conductor (not shown) to corresponding connection or contact areas 17 (see FIG. 4), so that a corresponding component inserted into the recess 11 and coming into contact with the connection areas 17, for example with connection contacts of a fuse etc., is electrically connected to the terminal pins 16. In this manner, a very efficient electric connection of one or several electronic components in the recess 11 to a printed circuit board on which the supporting component 10 is to be mounted can be made. In other embodiments, corresponding soldering surfaces can be provided instead of the terminal pins 16, such that an SMD design can be realized, wherein then for example with a corresponding shaping of the protrusion 7, a plane surface for vacuum exhaust during the assembly process can be provided.

In further embodiments, where reference is also made to FIGS. 1 to 4, the supporting component 10 comprises a base 1 for assembling an inductive element, on the top face 3 of the base 1, a protrusion 7 for accommodating the inductive element 9 being embodied, and in the protrusion 7 a recess 11 ending in the bottom face 5 of the base 1 for accommodating an electronic component or a ferrite element being embodied.

In a further embodiment, the inductive element 9 is an interference suppression coil.

In a further embodiment, the base 1 is a one-piece moulded plastic part, preferably made of plastoferrite.

In a further embodiment, an interference suppression coil device with an interference suppression coil 9 is provided, comprising a closed toroidal core 13 and at least two suppression coils 15*a*, 15*b* wound around the toroidal core 13 and essentially diametrically opposed with respect to the toroidal core 13, wherein the interference suppression coil device further comprises a supporting component 10 for accommodating the interference suppression coil 9, and wherein the supporting component 10 comprises a base 1, on the top face 3 of which a protrusion 7 is embodied, wherein the interference suppression coil 9 is assembled on the top face 3 of the base 1, such that the protrusion 7 is enclosed by the toroidal core 13.

In a further embodiment of the interference suppression coil device, in the protrusion 7, a recess 11 ending in the bottom face 5 of the base 1 for accommodating an electronic component or a ferrite element is embodied.

In a further embodiment, the outer shape of the protrusion 7 is embodied such that the protrusion 7 is accommodated by the core 13 with the suppression coils arranged thereon in an essentially interlocking manner.

The invention claimed is:

1. An interference suppression coil device, comprising:
an interference suppression coil with a toroidal core, and
a supporting component for accommodating the interference suppression coil, wherein the supporting component comprises:
a base with a top face facing the interference suppression coil, and
a protrusion embodied at the top face, and wherein the toroidal core at least partially encloses the protrusion,
wherein a recess for accommodating an electronic component or a magnetic element is embodied in the protrusion, and
wherein the protrusion has an essentially rectangular cross sectional form with a substantially circular bulging between end portions and forming an essentially planar surface for vacuum exhaust, the substantially circular bulging having a top surface that is continuous over a diameter of the bulging.

2. The interference suppression coil device according to claim 1, wherein the toroidal core is a closed toroidal core.

3. The interference suppression coil device according to claim 1 or 2, wherein the interference suppression coil comprises one or several suppression coils wound around the toroidal core.

4. The interference suppression coil device according to claim 3, wherein at least two suppression coils are provided and arranged essentially diametrically opposed with respect to the toroidal core.

5. The interference suppression coil device according to claim 1, wherein the recess ends in a bottom face of the base.

6. The interference suppression coil device according to claim 1 or 5, wherein the recess ends in a periphery of the protrusion facing away from the top face of the base.

7. The interference suppression coil device according to claim 1, wherein the base is a one-piece moulded plastic part.

8. The interference suppression coil device according to claim 1, wherein the base is made of plastoferrite.

9. The interference suppression coil device according to claim 1, wherein the protrusion is embodied axially symmetrically with respect to an axis of symmetry extending perpendicularly to the top face of the base.

10. The interference suppression coil device according to claim 1, wherein the protrusion comprises at least one lateral swelling for positioning the interference suppression coil.

11. The interference suppression coil device according to claim 10, wherein the at least one swelling is embodied for frictional engagement with the interference suppression coil.

12. The interference suppression coil device according to claim 1, wherein further several terminal pins are provided of which at least one terminal pin is connected with a conductor leading to the recess.

13. The interference suppression coil device according to claim 1, wherein the electronic component comprises a capacitor.

14. The interference suppression coil device according to claim 1, wherein the electronic component comprises a fuse.

15. The interference suppression coil device according to claim 1, wherein the electronic component comprises a diode.

16. The interference suppression coil device according to claim 1, wherein the supporting component is embodied for SMD construction.

17. An interference suppression coil device, comprising:
an interference suppression coil with a toroidal core, and
a supporting component for accommodating the interference suppression coil, wherein the supporting component comprises:
a base with a top face facing the interference suppression coil, and
a protrusion embodied at the top face, and wherein the toroidal core at least partially encloses the protrusion,
wherein a recess for accommodating an electronic component or a magnetic element is embodied in the protrusion, and
wherein the protrusion has an essentially rectangular cross sectional form with an outwardly extending bulge between end portions and forming an essentially planar surface for vacuum exhaust, the outwardly extending bulge having a top surface that is continuous over an entire width of the bulge.

18. The interference suppression coil device according to claim 17, wherein the edges of the bulge are arcuate.

* * * * *